US009057579B2

(12) United States Patent
Rorick et al.

(10) Patent No.: US 9,057,579 B2
(45) Date of Patent: Jun. 16, 2015

(54) QUICK DRAW GUN HOLSTER

(71) Applicant: SureFire, LLC, Fountain Valley, CA (US)

(72) Inventors: Steven Rorick, Riverside, CA (US); John W. Matthews, Newport Beach, CA (US)

(73) Assignee: SureFire, LLC, Fountain Valley, CA (US)

( * ) Notice: Subject to any disclaimer, the term of this patent is extended or adjusted under 35 U.S.C. 154(b) by 112 days.

(21) Appl. No.: 13/662,352

(22) Filed: Oct. 26, 2012

(65) Prior Publication Data

US 2013/0299534 A1 Nov. 14, 2013

Related U.S. Application Data

(63) Continuation-in-part of application No. 13/470,063, filed on May 11, 2012.

(51) Int. Cl.
*F41C 33/02* (2006.01)

(52) U.S. Cl.
CPC ..... *F41C 33/02* (2013.01); *F41C 33/0236* (2013.01); *F41C 33/0263* (2013.01); *F41C 33/0272* (2013.01)

(58) Field of Classification Search
CPC .. F41C 33/02; F41C 33/0236; F41C 33/0245; F41C 33/0254; F41G 1/35
USPC ..... 224/244, 238, 191–198, 912, 243; D3/222; 362/110–114; 42/146, 114, 42/123, 132
See application file for complete search history.

(56) References Cited

U.S. PATENT DOCUMENTS

| | | | | |
|---|---|---|---|---|
| 2,336,718 | A | 12/1943 | Davis | |
| 3,550,822 | A | 12/1970 | Lloyd | |
| 4,713,889 | A | 12/1987 | Santiago | |
| 4,912,867 | A | 4/1990 | Dukes, Jr. | |
| 6,112,962 | A | 9/2000 | Matthews | |
| 6,267,279 | B1 * | 7/2001 | Matthews | 224/243 |
| 7,395,627 | B2 | 7/2008 | La France et al. | |
| 8,215,525 | B2 * | 7/2012 | Rassias | 224/245 |
| 8,602,276 | B2 | 12/2013 | Tyybakinoja | |
| 2005/0024807 | A1 | 2/2005 | Cerovic et al. | |
| 2005/0224537 | A1 | 10/2005 | Rassias | |
| 2006/0026886 | A1 | 2/2006 | Doukas | |
| 2006/0157520 | A1 | 7/2006 | Clifton, Jr. | |
| 2006/0226185 | A1 | 10/2006 | Har-Shen | |
| 2008/0110947 | A1 | 5/2008 | Pikielny | |
| 2008/0121670 | A1 | 5/2008 | Buress | |
| 2011/0011904 | A1 | 1/2011 | Schultz et al. | |
| 2012/0097718 | A1 | 4/2012 | Baumann et al. | |

FOREIGN PATENT DOCUMENTS

| | | |
|---|---|---|
| DE | 10 2007 049 954 | 4/2009 |
| FR | 2 659 430 | 9/1991 |
| WO | WO 95/13515 | 5/1995 |
| WO | WO 98/40686 | 9/1998 |
| WO | WO 2009/064326 | 5/2009 |

* cited by examiner

*Primary Examiner* — Justin Larson
*Assistant Examiner* — Phillip Schmidt
(74) *Attorney, Agent, or Firm* — Haynes and Boone, LLP

(57) ABSTRACT

A holster for a handgun includes a plurality of projecting features for engaging receiving features on a handgun component. The holster includes a locking feature controlled by a mechanism to selectively engage or disengage the handgun component from the holster.

18 Claims, 18 Drawing Sheets

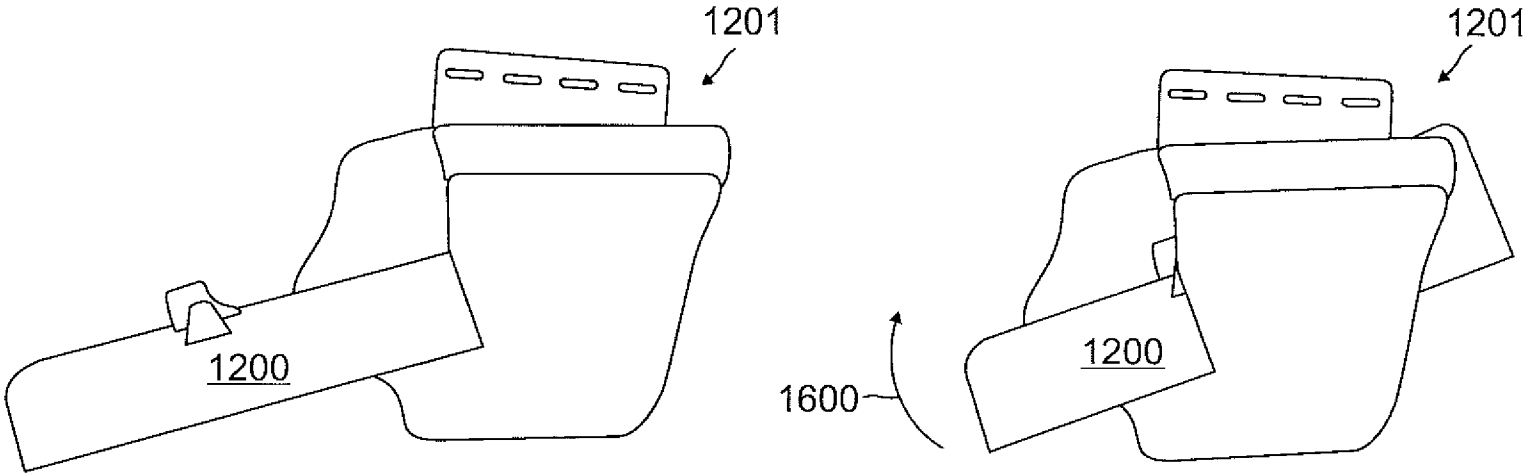
FIG. 16a
FIG. 16b
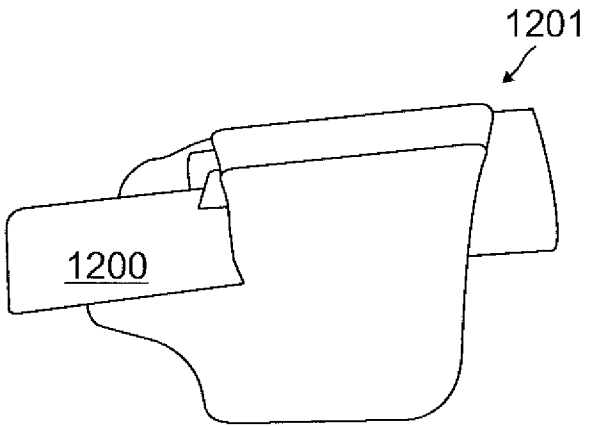
FIG. 16c

QUICK DRAW GUN HOLSTER

RELATED APPLICATION

This application is a continuation-in-part of U.S. application Ser. No. 13/470,063, filed May 11, 2012, the contents of which are incorporated by reference in their entirety.

BACKGROUND

1. Technical Field

This disclosure relates to firearms in general, and in particular, to embodiments of a quick draw holster for a handgun that enables the gun to be carried securely on the person of a user during strenuous physical activities, yet which enables the gun to be drawn for use quickly, safely, and reliably.

2. Related Art

Holsters for carrying a handgun on the person of a wearer are widely known in the field of firearms and have been in use for many years. Some holsters rely on friction to secure the handgun in the holster, but this arrangement might not be suitable during certain movements of the wearer that could cause the frictional grip of the holster on the gun to be broken.

Other holsters rely on an "over-center" design that incorporates one or more springs to secure the gun. This type of holster has the drawback that certain accelerations applied to the holster can act to compress the spring(s) and cause an unexpected release of the gun from the holster at a critical moment.

Additional holster designs have incorporated straps, flaps, hood enclosures, and the like, to secure the gun therein. However, unfastening these enclosures before drawing the gun can take an unacceptable amount of time in exigent circumstances, e.g., combat.

Also, in some instances, the handgun can be equipped with an accessory, such as a silencer, a light and/or a laser sighting device, in which case, the holster must be capable of accommodating such accessories, yet still enable the gun to be removed from the holster with a quick and short draw, preferably with a length that is shorter than the overall length of the gun and accessory combination.

A need therefore exists for handgun holsters that can accommodate a gun with or without accessories mounted thereon and enable it to be carried securely on the person of a wearer, yet which also enable the gun to be drawn from the holster for use in a quick, safe, and reliable manner

SUMMARY

In accordance with the present disclosure, novel quick draw hand gun holsters are described, together with methods for using them, that enable the guns to mount accessories, such as silencers, lights and/or lasers, and to be carried securely on the person of a user during strenuous physical activities, yet which enable them to be drawn for use quickly, safely and reliably.

In accordance with an embodiment, a holster is provided that includes: an adapter having an internal cavity defined by a pair of generally parallel side walls held in spaced opposition to each other by a top wall, the internal cavity being configured to receive a handgun component; a plurality of fixed projecting features on an inner surface of the side walls and projecting into the internal cavity, each fixed projecting feature adapted to be received by corresponding receiving features on the handgun component; a movable projecting feature on an inner surface of the side walls, the movable projecting feature being resiliently biased to project into the internal cavity, the movable projecting feature adapted to be engaged by a latching feature on the handgun component; and a mechanism for actuating the movable projecting feature against its resilient bias so as to withdraw the movable projecting feature from engagement with the latching feature.

In accordance with another embodiment, a handgun component adapted to be received by a holster is provided that includes: an elongated body having a distal end and opposing sides; a first pair of slots adjacent the distal end on the opposing sides, each slot in the first pair being configured to receive a corresponding pin from the holster; and a second pair of slots proximally located with regard to the first pair of slots on the opposing sides, each slot in the second pair being configured to receive a corresponding pin from the holster; and a latching recess on one of the opposing sides, the latching recess being configured to receive a locking pin from the gun holster.

In accordance with yet another embodiment, A method of engaging a handgun component into a holster is provided that includes: while first projecting features in the holster engage first guide walls on the handgun component, inserting the handgun component into the holster until the first projecting features engage stops on the handgun component; and while the first projecting features engage the stops, rotating the handgun component about the stops so that second projecting features in the holster engage second guide walls on the handgun component.

The scope of this invention is defined by the claims appended hereafter, which are incorporated into this section by reference. A more complete understanding of embodiments of the present invention will be afforded to those skilled in the art, as well as a realization of additional advantages thereof, by a consideration of the following detailed description of one or more example embodiments. Reference will be made to the appended sheets of drawings that will first be described briefly, and within which like reference numerals are used to identify like elements illustrated in one or more of the figures thereof.

BRIEF DESCRIPTION OF THE DRAWINGS

FIG. 16*a* is a perspective view of a user initially inserting the gun slide of FIG. 12 into the holster;

FIG. 16*b* is a perspective view of a user having fully distally inserted the gun slide of FIG. 16*a* prior to engaging the latch recess;

FIG. 16*c* is a perspective view of a user having completely engaged the gun slide of FIG. 16*b* into the holster such that the latch recess engages the locking pin.

DETAILED DESCRIPTION

Figure 1B:
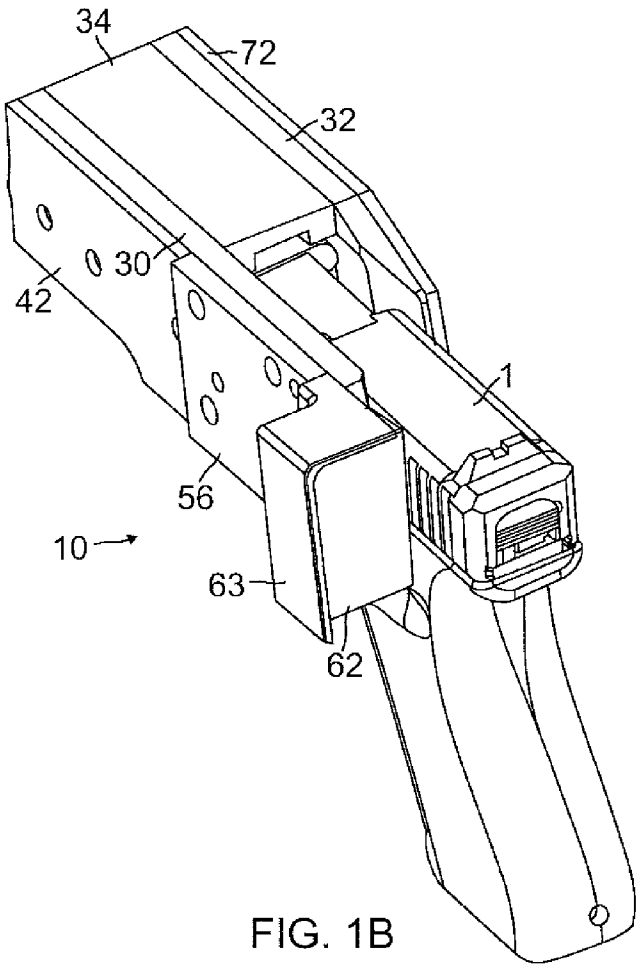
FIG. 1B is an upper, left side, rear perspective view of the holster and gun of FIG. 1A.
Figure 1A:
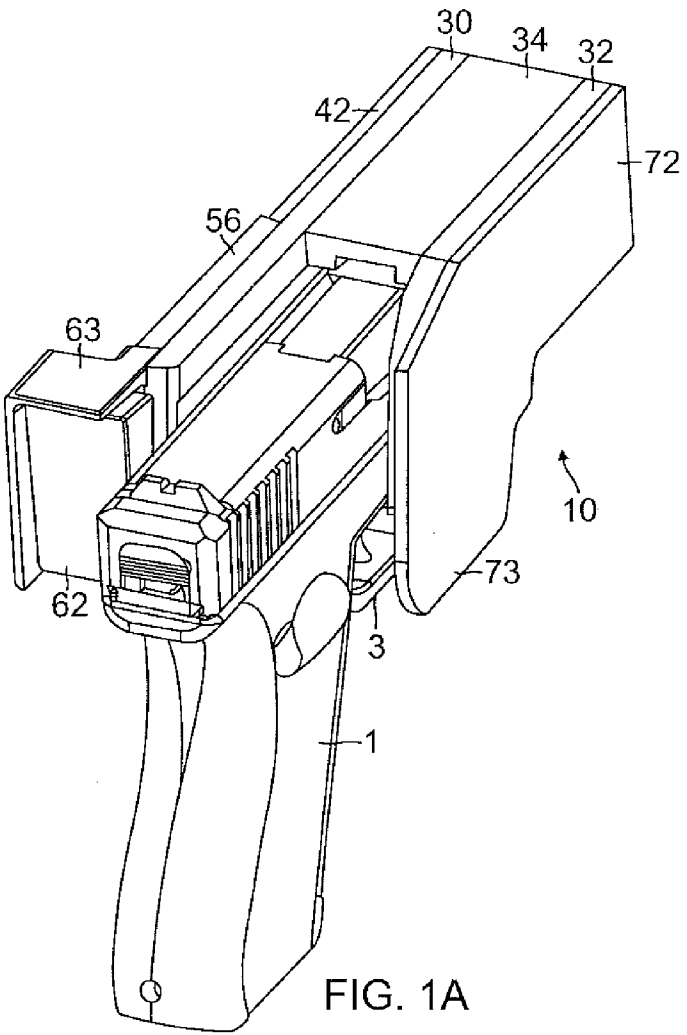
FIG. 1A is an upper, right side, rear perspective view of a quick draw holster and associated handgun in accordance with a first embodiment.
Figure 1C:
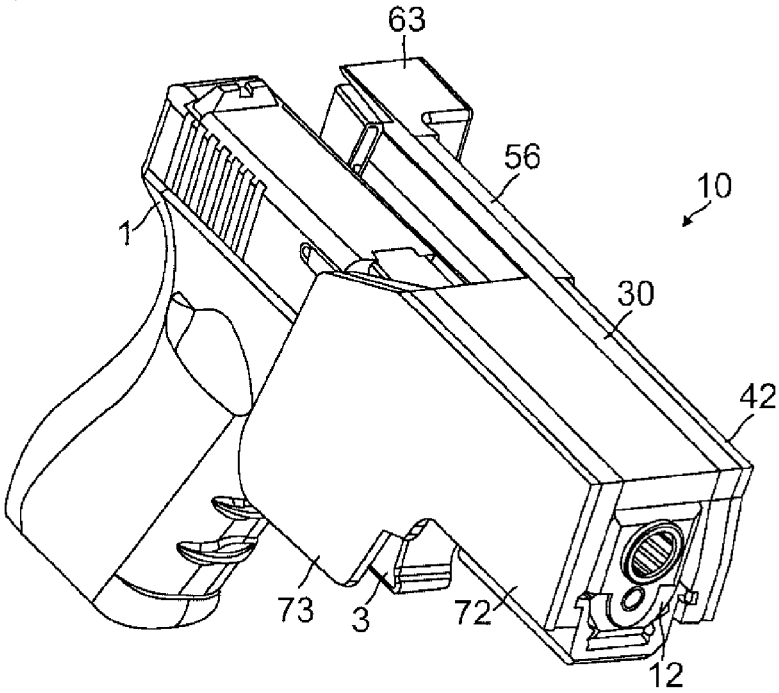
FIG. 1C is an upper, left side, front perspective view of the holster and gun of FIG. 1A.
Figure 1D:
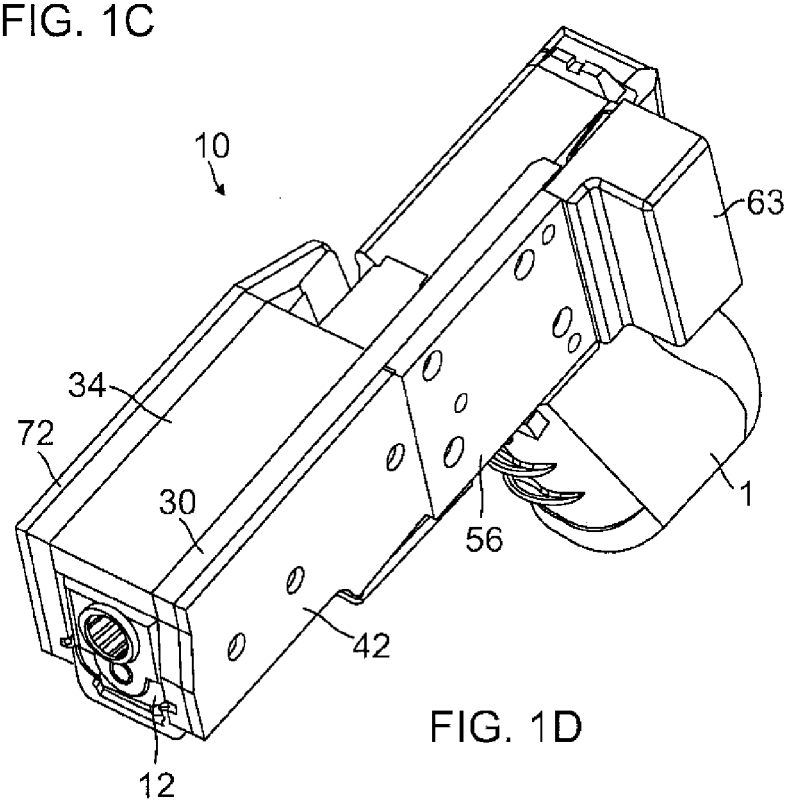
FIG. 1D is an upper, right side, front perspective view of the holster and gun of FIG. 1A.
Figure 2A:
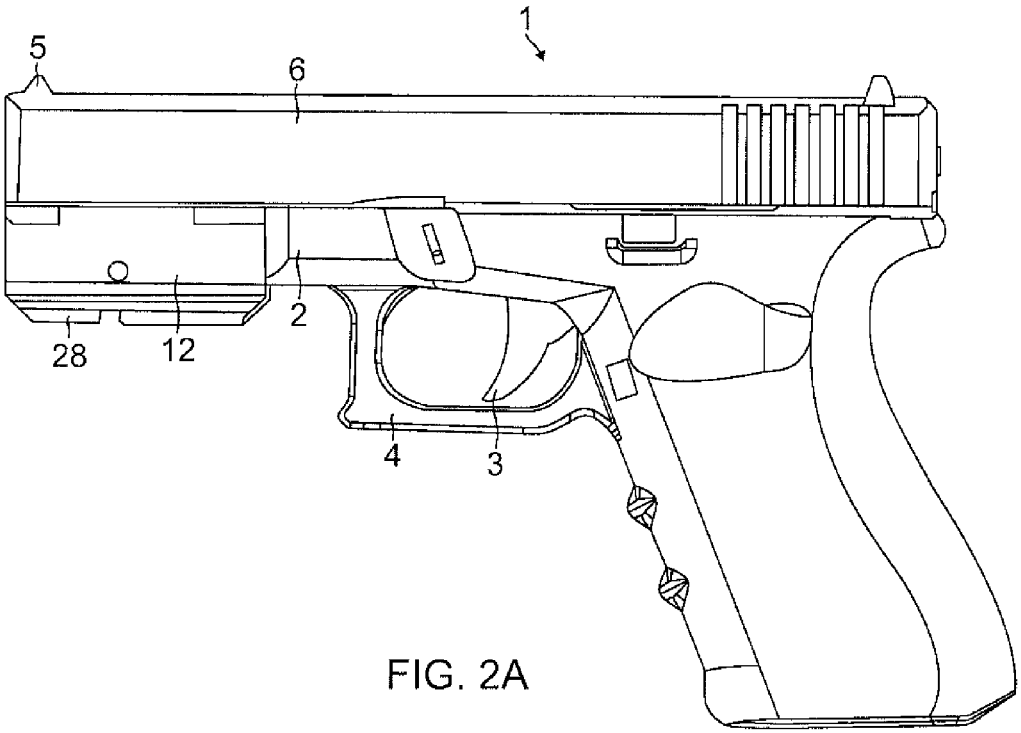
FIG. 2A is a left side elevation of an example embodiment of a holster adapter in accordance with the first embodiment, shown coupled to an associated handgun.
Figure 2B:
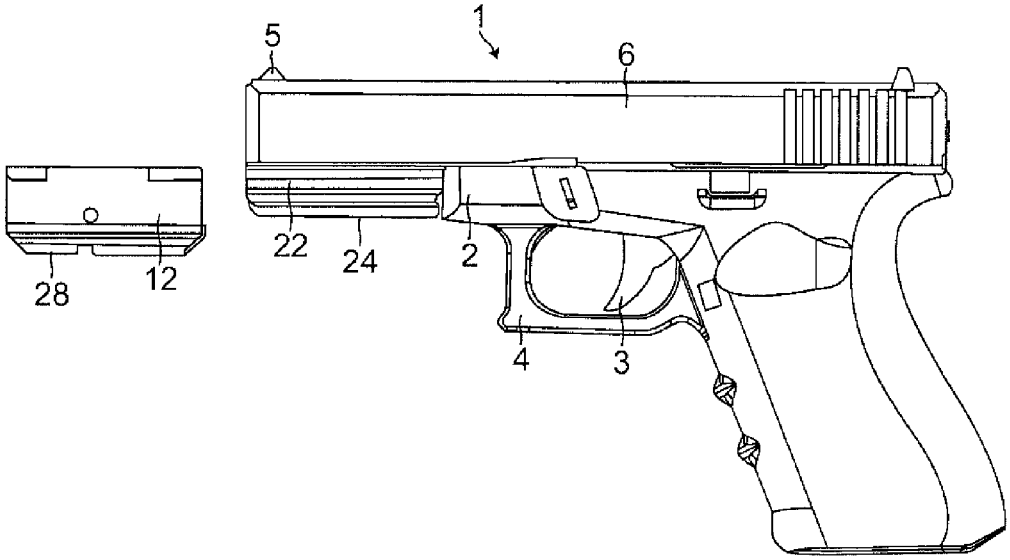
FIG. 2B is an exploded left side elevation view of the holster and adapter of FIG. 2A.
Figure 3A:
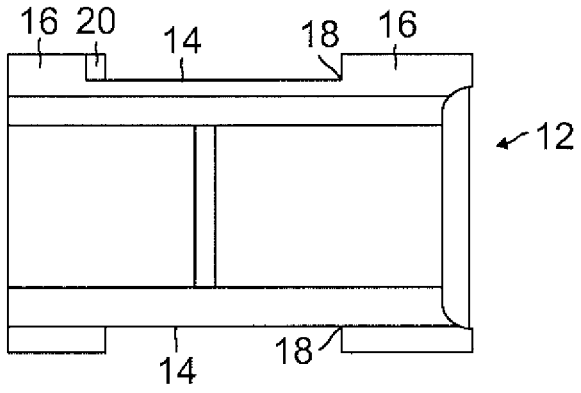
FIGS. 3A-3E are top plan, front end elevation, left side elevation, rear end elevation, and bottom plan views, respectively, of the example holster adapter of FIGS. 2A and 2B.
Figure 3B:
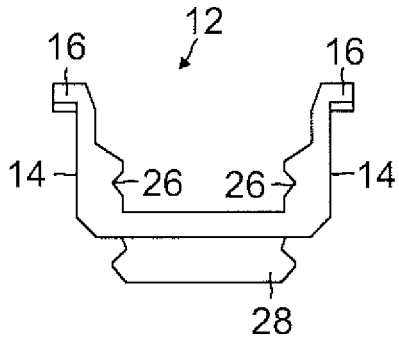
Figure 3C:
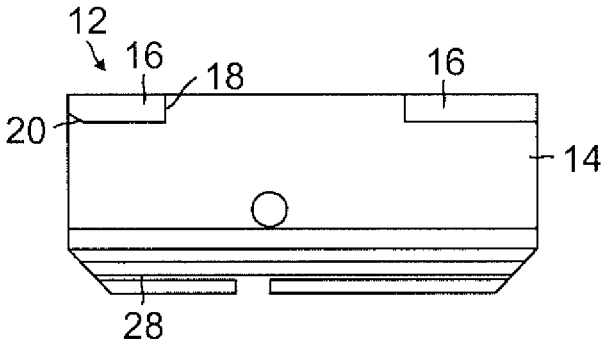
Figure 3D:
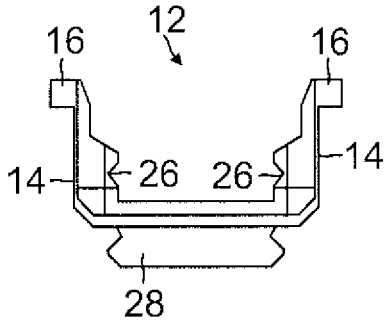
Figure 3E:
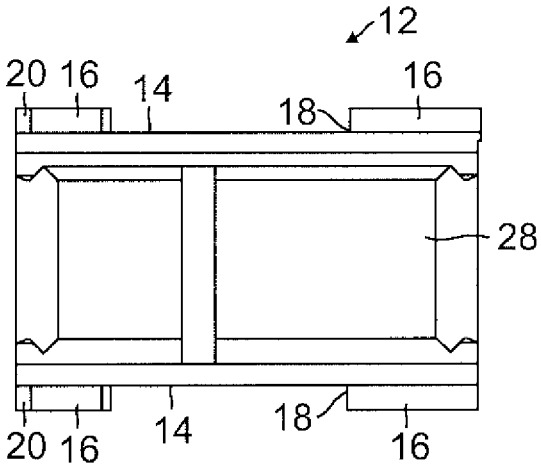

In accordance with the present invention, holsters for hand guns are provided that enable guns to be carried securely on the person of a wearer, yet which also enable the gun and accessories to be drawn from the holster for use in a quick, safe and reliable manner. The secure holstering of the gun and its quick release from the holster also accommodate accessories mounted on the gun, such as silencers, flashlights and/or laser targeting devices, The holsters may be chest mounted, more preferably in a concealed fashion, but can also be carried on a high or a low belt rig. The holsters of the present invention can be used on a wide variety of hand held guns, although their internal mechanisms remain substantially similar. To accommodate different handguns, the shape and size of the constituent parts can be easily varied during their manufacture. As an alternative to using discrete "billet" parts, the holster housing may be manufactured using a molding process.

The holster engages a hand gun component using complementary features. One element (either the hand gun component or the holster) includes a projecting feature such as one or more lands or pins whereas the remaining element includes a receiving feature such as one or more grooves or recesses to receive the projecting feature(s). There are thus two main embodiments: 1) a first embodiment that has the projecting elements on the hand gun component and the receiving elements in the holster; and 2) a second embodiment that has the projecting elements on the holster and the receiving elements in the hand gun component. The first embodiment will be discussed initially followed by a discussion of the second embodiment.

The First Embodiment

A quick draw holster 10 in accordance with the first embodiment is illustrated in the perspective views of FIGS. 1A-1D, where it is shown carrying an associated handgun 1. In the particular embodiment illustrated, the associated gun 1 comprises, as an example, a Glock semiautomatic pistol. However, as will become clear in the following description, the holster 10 can easily be modified to accommodate a wide variety of other types of pistols, such as the Colt M1911 pistol, the H&K P7 and USP pistols, the Steyr M series pistols, the Smith & Wesson MP series pistols, and many others, as well.

As illustrated in, e.g., FIGS. 2A, 2B and 3A-3E, the holsters 10 of the present invention utilize a holster adapter 12 that serves as an interface between the holster 10 and the associated gun 1. Thus, no direct contact occurs between the holster 10 and the associated gun 1. Rather, the holster 10 holds, retains and ejects the gun 1 through the agency of the adaptor 12. As may be seen in FIGS. 2A, 2B and 3A-3E, the example adapter 12 illustrated, which is configured to couple the holster 10 to the Glock pistol discussed above, incorporates a generally U-shaped cross-section configured to be coupled to a lower surface of a front end portion of the gun's receiver 2. The adapter 12 has opposite side walls 14, each of which has one of a pair of forwardly extending longitudinal lands 16 disposed thereon. Each land 16 incorporates a notch 18 disposed in a lateral edge thereof that can be used as discussed below to retain the adapter 12, and hence the gun 1, in the holster 10. In some embodiments, the front and rear ends of the longitudinal lands 16 can incorporate ramp features 20 that can facilitate interaction with the retaining and/or ejector mechanisms described in more detail below.

As those of some skill in the art will appreciate, some handguns 1, such as the example Glock illustrated in the figures above, incorporate a pair of longitudinal grooves 22 (see FIG. 2B) on the lower surface of a front end portion of the gun's receiver 2 that defines a mounting rail 24 for mounting an accessory, such as lights or a laser sighting devices of a known type. As illustrated in the cross-sectional views of the adapter 12 in FIGS. 3B and 3D, the adapter 12 can utilize these features for coupling the adapter 12 to the gun 1 by incorporating complementary rail-receiving grooves 26 on the interior walls of the adapter 12, then reproduce the accessory mounting rail 24 of the gun 1 with a similar mounting rail 28 disposed on the lower surface of the adapter 12. In this manner, the functionality of the accessory mounting rail 24 on the gun 1 is preserved.

Figure 9:
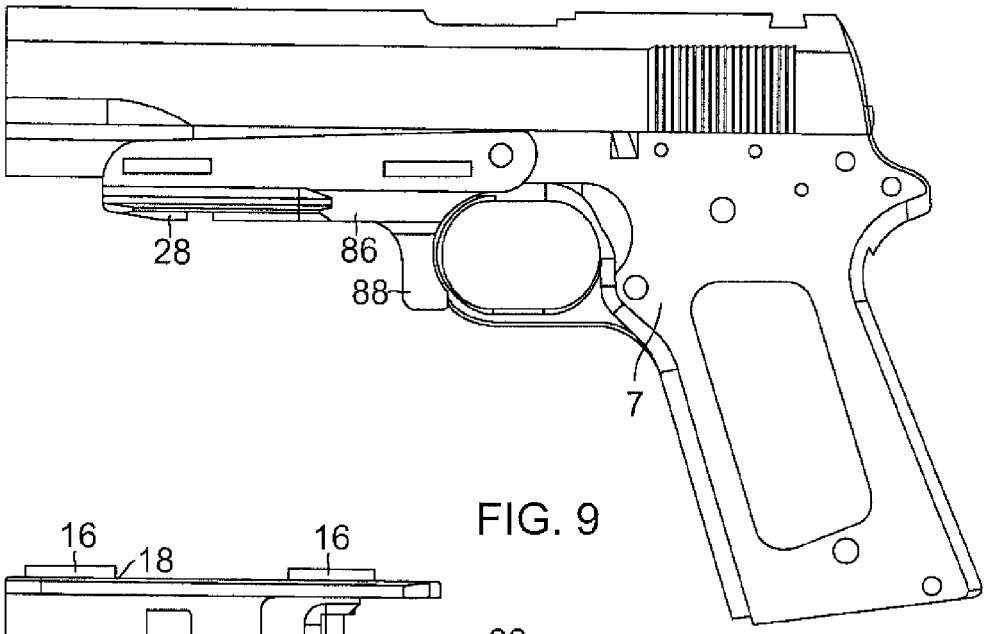
FIG. 9 is a left side elevation view of an alternative embodiment of a holster adapter in accordance with the present invention, shown coupled to another handgun.
Figure 10A:
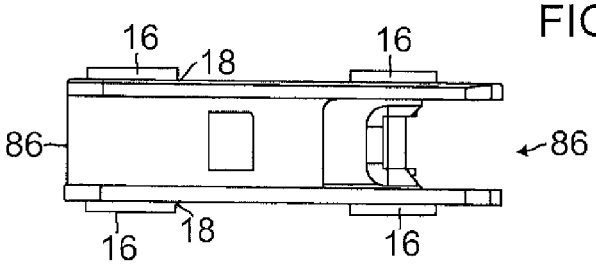
FIGS. 10A-10E are top plan, front end elevation, left side elevation, rear end elevation, and bottom plan views, respectively, of the alternative holster adapter of FIG. 9.
Figure 10B:
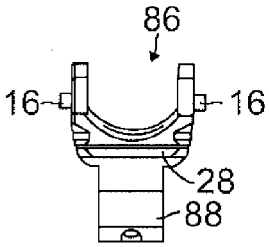
Figure 10C:
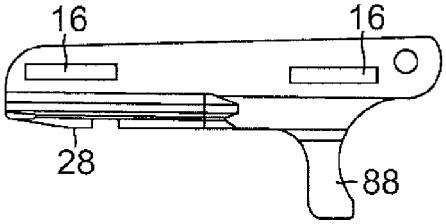
Figure 10D:
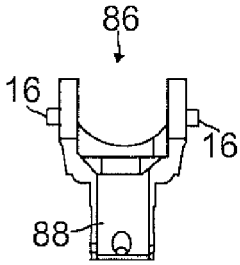
Figure 10E:
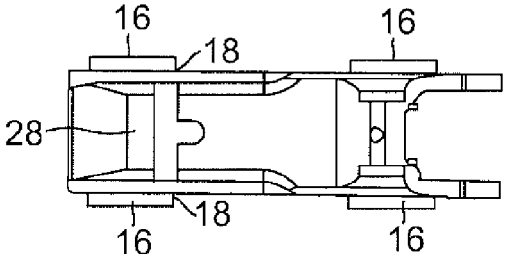

Indeed, as discussed below in connection with the alternative adapter 86 and gun 7 embodiment of FIG. 9, the holster adapters of the present invention can be used to provide an accessory mounting feature, such the mounting rail 28, on guns 7 of a type that do not ordinarily include an accessory mounting feature. Thus, in some embodiments, the holster adapter 12 can serve two purposes, viz., adapting the gun 1 to the holster 10, and providing the gun 1 with an accessory mounting feature.

Figure 4A:
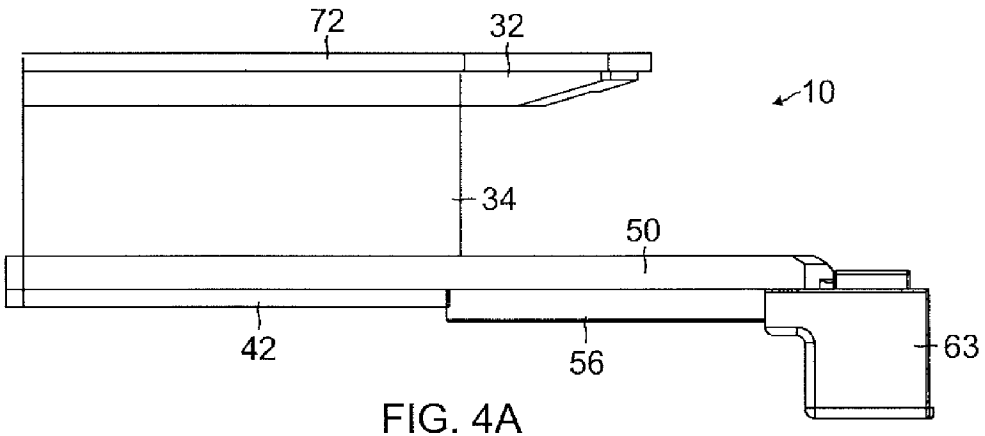
FIGS. 4A-4F are top plan, left side elevation, rear end elevation, right side elevation, bottom plan, and front end elevation views, respectively, of the holster of FIG. 1A.
Figure 4B:
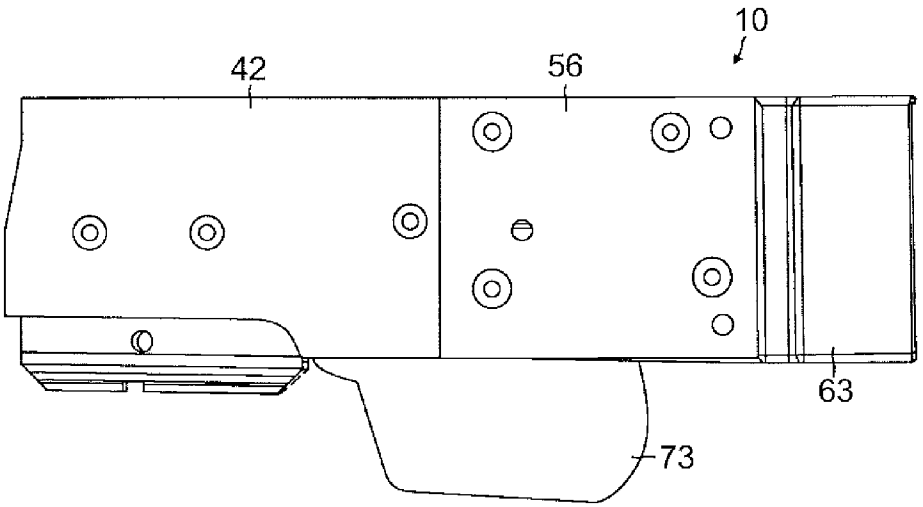
Figure 4C:
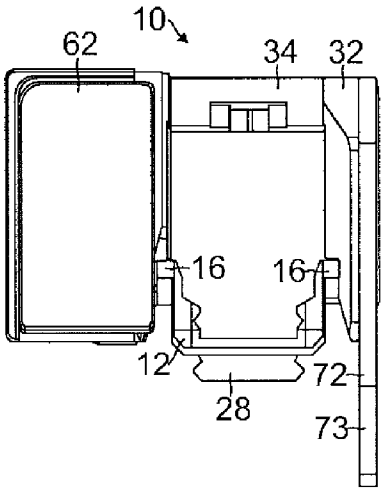
Figure 4F:
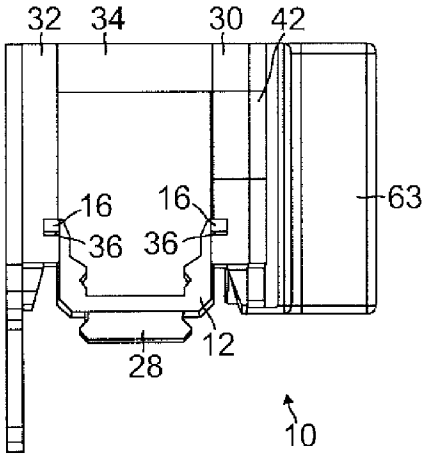
Figure 4D:
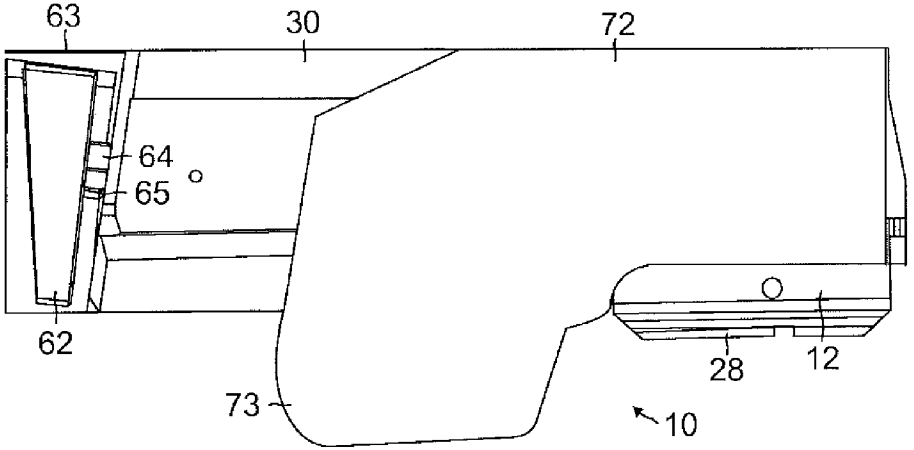
Figure 4E:
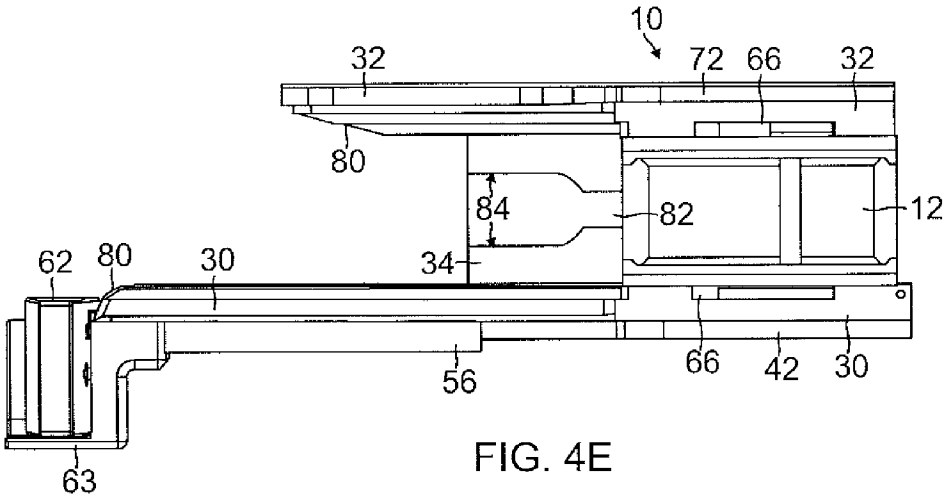
Figure 5:
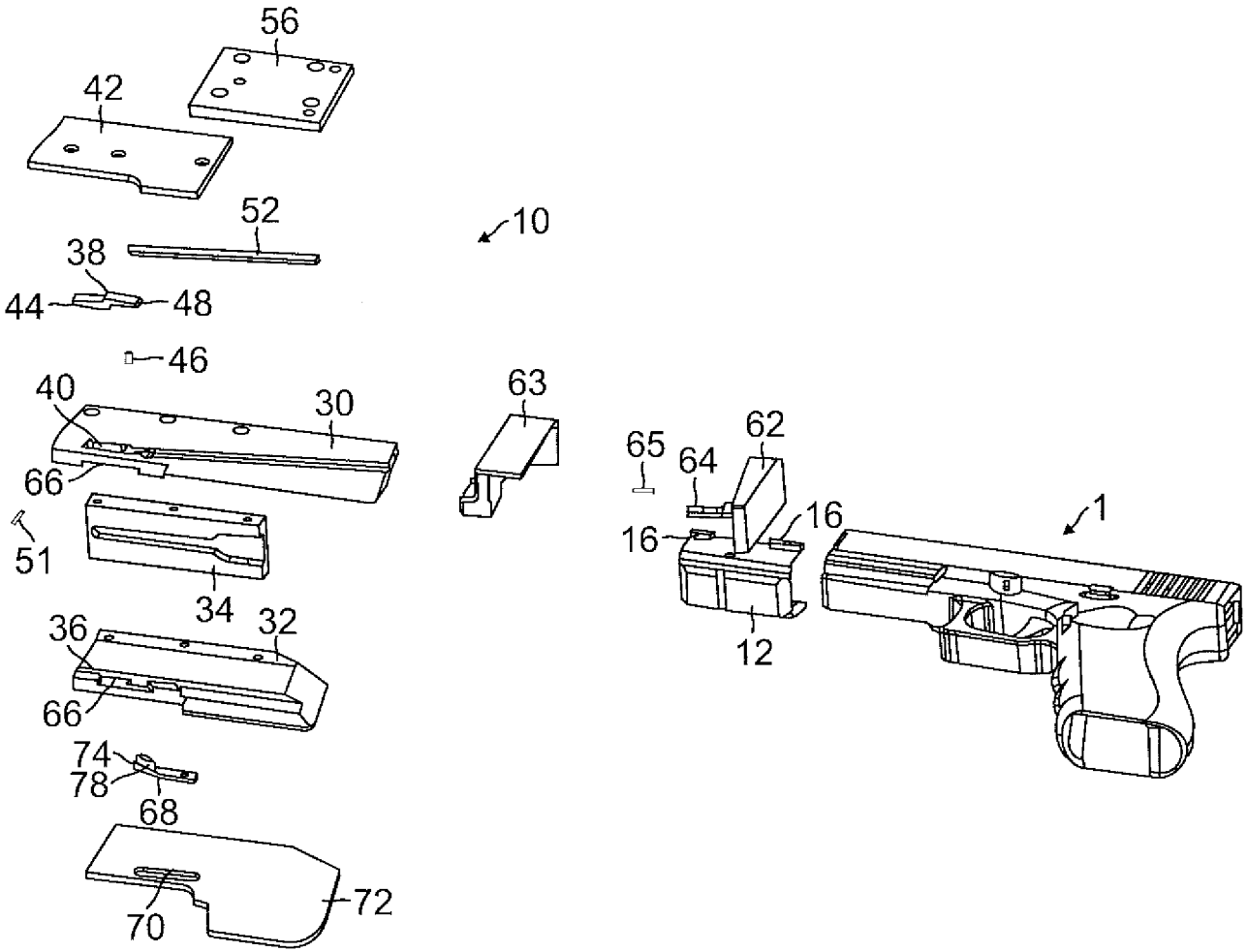
FIG. 5 is an exploded lower, left side, rear perspective view of the holster and associated gun, showing constituent parts of the holster of FIG. 1A.
Figure 6:
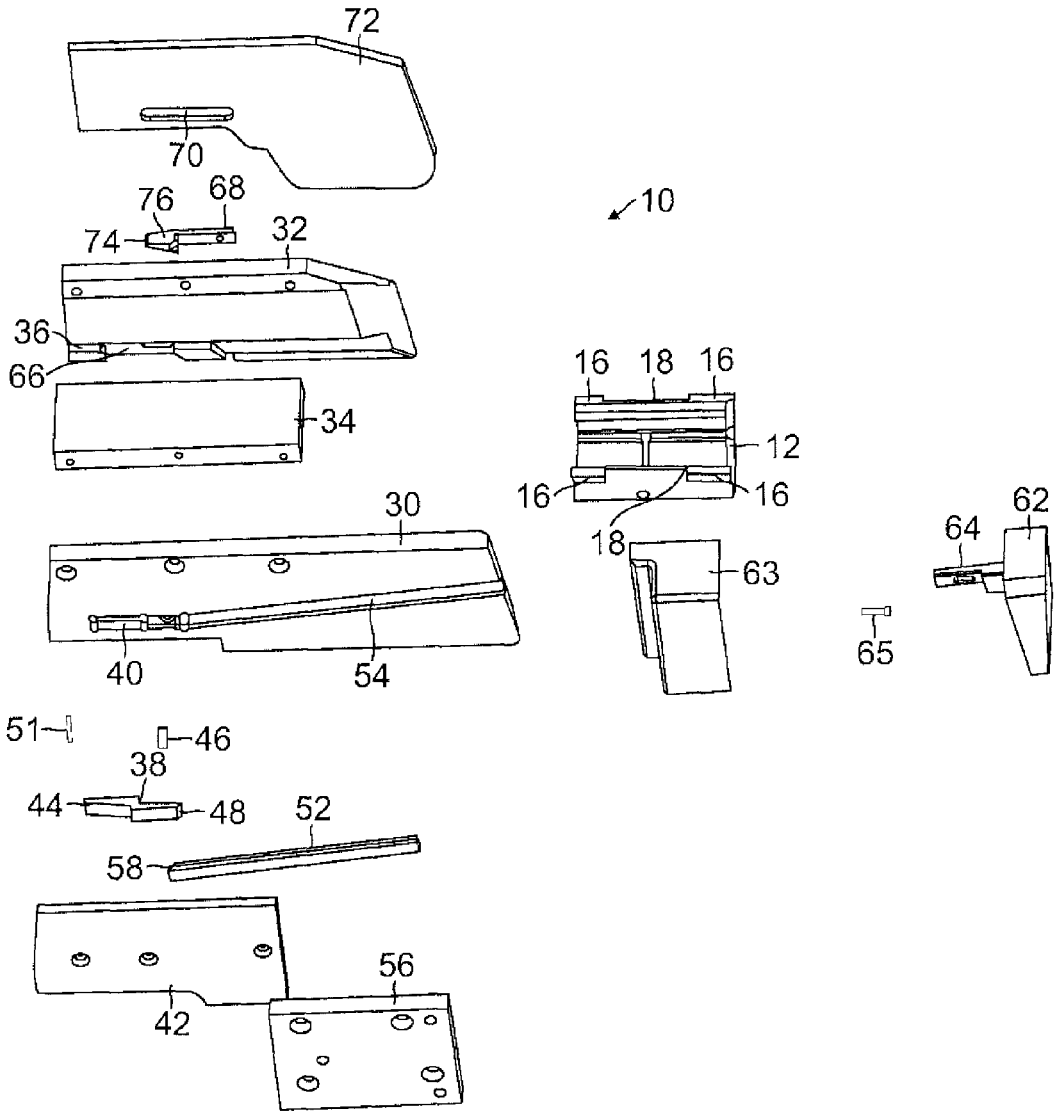
FIG. 6 is an exploded upper, left side perspective view of the holster of FIG. 1A, from which the associated gun has been omitted.
Figure 7:
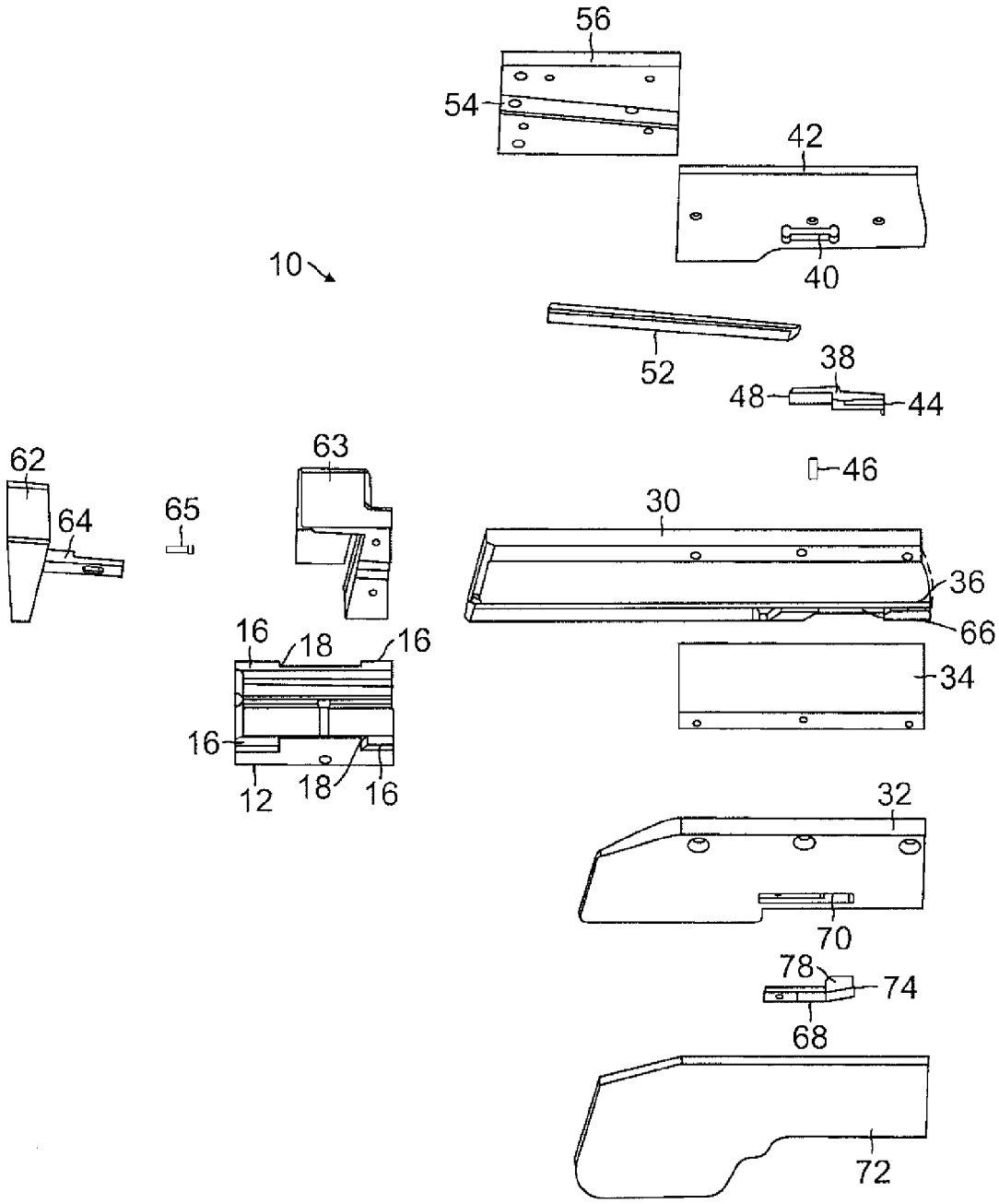
FIG. 7 is an exploded upper, right side perspective view of the holster of FIG. 1A.
Figure 11A:
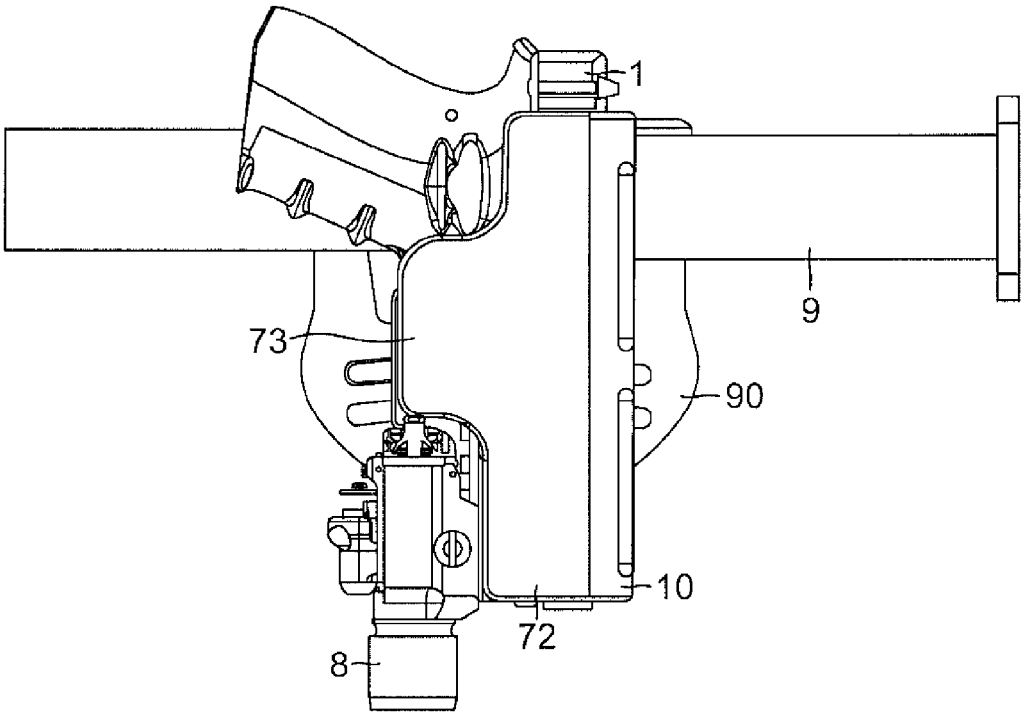
FIG. 11A is a right side elevation view of an example embodiment of a holster in accordance with the present invention, showing the holster coupled to the belt of a wearer and carrying an associated handgun having an accessory mounted thereon.
Figure 11B:
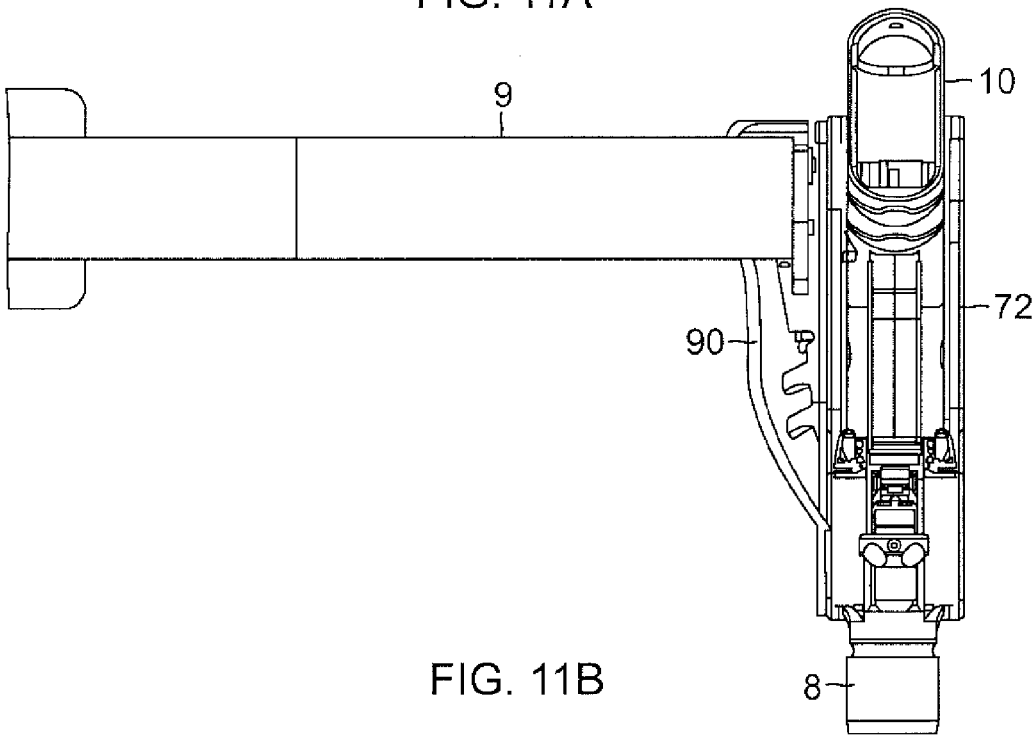
FIG. 11B is a rear end elevation view of the holster, gun and accessory of FIG. 11A.

Turning now to the example holster 10 itself, FIGS. 4A-4F illustrate the holster 10 in an assembled form, and the exploded views of FIGS. 5-7 illustrate its constituent parts and their relative arrangement. With reference to these figures, the example holster 10 can be seen to comprise a generally Π-shaped housing having a pair of side walls or plates 30 and 32 held in spaced opposition to each other by a top plate or spacer wall 34 coupled between corresponding upper edges thereof. It will be appreciated that elements 30, 32, and 34 comprise plates in a "billet" embodiment such that the plates would then be fastened, glued, or welded together to form the housing. In contrast, elements 30, 32, and 34 comprise walls in a molded housing embodiment. As used herein, the term "wall" will refer to either molded or billet embodiments. The remaining description will refer to these elements as "plates" but it will be appreciated that molded embodiments are within the scope of the disclosure. In that regard, holster 10 may comprise metal, polymer, or fiber components. For descriptive purposes, the side plate 30 is sometimes referred to herein as the "left" or "medial" side plate 30, as it is disposed closest to the medial plane of a wearer when the holster is worn on the wearer's hip, as illustrated in FIGS. 11A and 11B, whereas, the side plate 32 is sometimes referred to as the "right" or "distal" side plate 32.

As illustrated in, e.g., FIGS. 4F, and 5-7, each of the two side plate 30 and 32 has an interior surface containing one of a pair of forwardly extending longitudinal grooves 36 disposed therein, each of which is configured to receive a corresponding one of the longitudinal lands 16 of the adapter 12 in a slide-in engagement. Additionally, as discussed above, rather than rely on a simple but less reliable flap or "over-center" latching mechanism to retain the gun 1 in the holster 10, it is desirable to provide a more "positive" latching mechanism in the holster 10 that acts on the adapter 12 for that purpose, and consequently, it is also desirable to provide a convenient, reliable and quick-acting release mechanism for selectably releasing the gun 1 from the holster 10.

Figure 8:
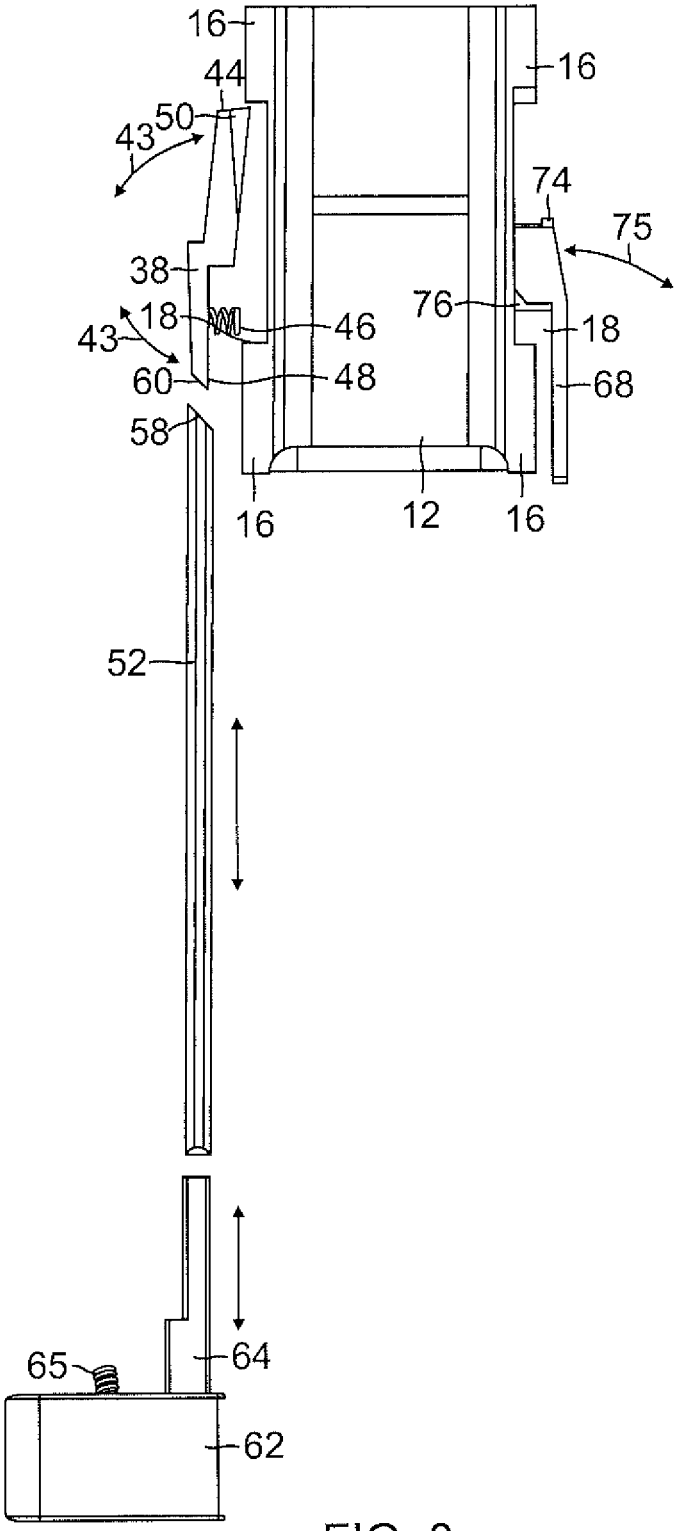
FIG. 8 is a top plan view of the first embodiment holster adapter, showing details of example latching, release and ejection mechanisms useable in association therewith.

FIG. 8 is a top plan view of the holster 10 in which all components of the holster 10, including the two side plates 30 and 32 and the top plate 34, have been omitted for purposes of illustrating the latching and release mechanisms. As illustrated in FIG. 8, in some embodiments, the latching mechanism can comprise an elongated pawl 38 that is pivotally disposed within a recess 40 in the medial or left side plate 30 of the housing and aligned with the longitudinal groove 36 therein. The pawl 38 can be captivated in the recess 40 by, e.g., a front-medial side cover plate 42 coupled to the left or medial side of the medial plate 30 (see, e.g., FIGS. 5-7) for pivotal movement in the direction indicated by the arrows 43.

The pawl 38 has a front end 44 that is resiliently biased, e.g., by a spring 46, into the adjacent longitudinal groove 36, an opposing rear end 48, and a ramp 50 disposed on a lateral surface thereof. The ramp 50 is configured to engage a front end of a corresponding one of the lands 16 of the adapter 12, and as a result, to pivot the front end 44 of the pawl 38 out of the adjacent longitudinal groove 36 when the corresponding land 16 is slid forwardly into the groove 36. In some embodiments, a stop mechanism, such as the roll pin 51 shown in FIGS. 5 and 6, can be included in the holster 10 housing to prevent the adapter 12 from sliding past a front end of the housing.

Thus, when the adapter 12 (and hence, the lands 16 and a gun 1 coupled to the adapter 12) are slid forwardly into the holster 10 such that the longitudinal lands 16 of the adaptor 12 slide into corresponding ones of the longitudinal grooves 36, a front end of the land 16 adjacent to the pawl 38 urges the front end 44 of the pawl 38 to the side, thereby allowing the lands 16 of the adapter 12 to proceed further into the longitudinal grooves 36 in the side plates 30 and 32, until the notch 18 in the lateral edge of the land 16 adjacent to the pawl 38 is positioned adjacent to the front end 44 of the pawl 38, at which point, the front end 44 of the pawl 38 pivots back into the adjacent longitudinal groove 36 so as engage the notch 18 in the land 16 of the adapter 12 and prevent the withdrawal of the adapter 12 (and hence, a gun 1 coupled to it) from the holster 10 until the latching mechanism is intentionally released with a release mechanism. Notch 18 and land 16 thus form a ratchet that engages pawl 38.

An example embodiment of such a release mechanism is also illustrated in FIG. 8. As shown in FIG. 8, the example release mechanism can comprise a push rod 52 that is slidably disposed in, e.g., a channel 54 defined between a medial wall of the medial side plate 30 and a rear-medial side cover plate 56 (see, e.g., FIGS. 6 and 7) for fore and aft movement behind the pawl 38. As illustrated in, e.g., FIG. 8, the push rod 52 has a front end with a chamfer 58 disposed thereon. The chamfer 58 is configured to pivot the front end 44 of the pawl 38 out of the adjacent longitudinal groove 36 in the direction of the arrow 43 when it is pushed into engagement with a complementary chamfer 60 disposed on the rear end 48 of the pawl 38. This causes the front end 44 of the pawl 38 to pivot out of engagement with the notch 18 in the adjacent land 16 of the adapter 12, thereby enabling the adapter 12 (and hence, a gun 1 coupled to it) to be withdrawn from the holster 10.

In the particular example embodiment illustrated in FIG. 8, a thumb actuated push button 62 is slidably disposed on the medial side plate 30 for fore and aft movement behind the push rod 52. The push button 62 has a forwardly protruding boss 64 with a front end disposed behind the push rod 52. The front end of the boss 64 is configured to engage a rear end of the push rod 52 and to urge the push rod 52 forward when the push button 62 is pressed by the user's thumb, thereby unlatching the adapter 12 for withdrawal from the holster 10. As illustrated in, e.g., FIGS. 5-8, in some embodiments, the thumb actuated push button 62 can be surrounded for protection against dirt or accidental actuation by a push button cover shroud 63 coupled to the side plate 30 and configured to cover at least two sides of the push button 62. A spring 65 disposed between the shroud 63 and the push button 62 can be used to bias the push button 62 in a rearward direction.

As discussed above, it is desirable for the holster 10 to provide for a very short "draw" of the gun 1 therefrom, and this is particularly so when an elongated accessory, such as a silencer or a laser is coupled to the muzzle or receiver 2 of the gun 1. In some embodiments of the present invention, this can be effected by an ejector mechanism that enables the adapter 12, and hence, a gun 1 coupled to it, to be ejected from the bottom of the holster 10 after a rearward (or upward, if the holster 10 is being worn on the wearer's hip) draw or pull of the gun 1 of only about 0.5 inch.

As illustrated in, e.g., FIGS. 5-8, in some embodiments, the "quick draw" ejector mechanism can comprise a slot 66 formed in the lower edge of each of the side plates 30 and 32 that extends between the lower edge of the plate and the longitudinal groove 36 therein. As illustrated in, e.g., FIG. 8, an elongated ejector cam 68 can be pivotally disposed within a recess 70 in one of the side plates, for example, in a recess 70 formed between a distal side surface of the distal side plate 32 and a distal side cover plate 72 disposed thereon, and held thereby in alignment with the adjacent longitudinal groove 36. The ejector cam 68 can have a front end 74 that is resiliently biased into the adjacent longitudinal groove 36. In some embodiments, this can be effected by a spring, as in the case of the latching pawl 38 discussed above. In another advantageous embodiment, the ejector cam 68 can be fabricated of a thermoplastic material having high stiffness, low friction and good dimensional stability, such as polyoxymethylene (e.g., DuPont Delrin) such that ejector cam 68 itself provides the resilience which enables it to be pushed out of the way as the gun is holstered.

In some embodiments, the distal side cover plate 72 can also be provided with a lower extension 73 configured to cover a trigger 3 and/or a trigger guard 4 of the gun 1 (see FIGS. 2A, 2B) when the gun 1 is disposed in the holster 10, as illustrated in FIGS. 11A and 11B. The extension 73 on the cover plate 72 can serve to prevent accidental contact with the trigger 3 of the gun 1 by the user when the gun 1 is being carried in the holster 10.

The front end 74 of the ejector cam 68 can include first and second ramps 76 and 78 respectively disposed on upper and lower surfaces thereof. The first ramp 76 can be configured to engage a front end of a corresponding one of the longitudinal lands 16 of the adapter 12 and to push the front end 74 of the ejector cam 68 laterally and out of the corresponding longitudinal groove 36 (in the direction of the arrow 75 in FIG. 8) when the corresponding land 16 is slid forwardly into the groove 36, thereby enabling the adapter 12 to bypass the ejector cam 68. The front end 74 of the cam 68 will then snaps back resiliently into the longitudinal groove 36 when the notch 18 of the corresponding land 16 is disposed adjacent to the front end 74 of the cam.

With respect to the ejection of the gun from the holster, as the adapter 12 and corresponding land 16 is then slid rearwardly in the corresponding longitudinal groove 36, the second ramp 78 on the lower surface of the front end 74 of the ejector cam 68 can be configured to engage a rear edge of the notch 18 in the lateral edge of the corresponding land 16 of the adapter 12, and thereby urge the adapter 12 (and hence, a gun 1 coupled to it) through the slots 66 at the lower edges of the side plates 30 and 32 and in a direction generally perpendicular to the longitudinal grooves 36 therein, i.e., through the bottom opening of the holster 10. In some embodiments, this ejection of the gun 1 can be effected by a rearward "draw" or "pull" of the gun 1 of only about 0.5 inch.

Advantageously, the adapter 12 and associated gun 1 can be inserted into the holster 10 via the same path by which it is ejected from the holster 10, i.e., into the bottom opening of the holster 10, through the slots 66 on the lower edges of the side plates 30 and 32, and thence, forwardly into the holster 10. This enables the gun 1 to be inserted into the holster 10 in two ways, i.e., through the rear of the holster 10 or through the bottom of the holster 10, as above.

Accordingly, a method embodiment for using the holster 10 of the present invention can comprise the steps of first coupling the adapter 12 to the gun 1, and then inserting the gun 1 and adapter 12 into the holster 10 such that the lands 16 of the adapter 12 are slidably received in corresponding ones of the longitudinal grooves 36 of the side plates 30 and 32 and the latching pawl 38 is engaged with a notch 18 in one of the lands 16 of the adapter 12.

As discussed above, the step of inserting the gun 1 and adapter 12 can comprise either 1) inserting the gun 1 and adapter 13 into a rear end of the holster 10 such that respective ones of front ends of the lands 16 of the adapter 12 enter into corresponding ones of rear ends of the longitudinal grooves 36 of the side plates 30 and 32, or alternatively, 2) inserting the gun 1 and adapter 13 into the bottom end of the holster 10 such that respective ones of front portions of the lands 16 of the adapter 12 pass through corresponding ones of the slots 66 of the side plates 30 and 32 and until an upper surface of each land 16 is in abutment with an upper surface of a corresponding one of the longitudinal grooves 36, and then sliding the gun 1 and adapter 12 forwardly in the grooves 36.

As illustrated in, e.g., FIG. 4E, as an aid to inserting the gun 1 and adapter 12 into the rear end of the holster 10 (or the "top" end thereof if the holster 10 is being worn upright on the wearer's hip), the medial and distal side plates 30 and 32 can be provided with inwardly sloping surfaces 80 on respective ones of the rear ends thereof, and the top or spacer plate 34 can include an elongated slot 82 having an enlarged entryway 84 extending forwardly in a lower surface thereof, the slot 82 and entryway 84 being adapted to receive a blade sight 5 (see FIGS. 8A, 8B) disposed on a front end of an upper surface of the slide 6 of the gun 1 in a slide in engagement.

As discussed above, embodiments of the holster 10 of the present invention can be used with a wide variety of handgun types. For example, FIG. 9 illustrates an alternative embodiment of a holster adapter 86, shown coupled to a lower surface of a front end portion of the receiver of another type of handgun 7, viz., a Colt M1911 pistol. As may be seen in the various elevation and plan views of the alternative adapter 86 in FIGS. 10A-10E, the adapter 86 can incorporate several of the features of the adapter 12 of FIGS. 3A-3E, such as the accessory mounting rail 28 and longitudinal lands 16 of the latter, as well as some additional features not found on the adapter 12, such as a positioning and mounting cup 88 disposed at the rear of the adapter 86 that is configured to enable the adapter to mount to the front surface of the trigger guard of the gun 7.

FIGS. 11A and 11B are right side and rear end elevation view of an example embodiment of a holster 10 in accordance with the present invention, showing the holster 10 coupled to the belt 9 of a wearer and carrying an associated handgun 1 having an accessory, viz., a laser sighting device 8, mounted thereon. As illustrated in these figures, the holster can include a belt loop structure 90 coupled to a proximal side of the holster 10, e.g., to the rear-proximal side cover plate 56, to enable the holster 10 to be worn on a belt 9.

The Second Embodiment

Figure 12:
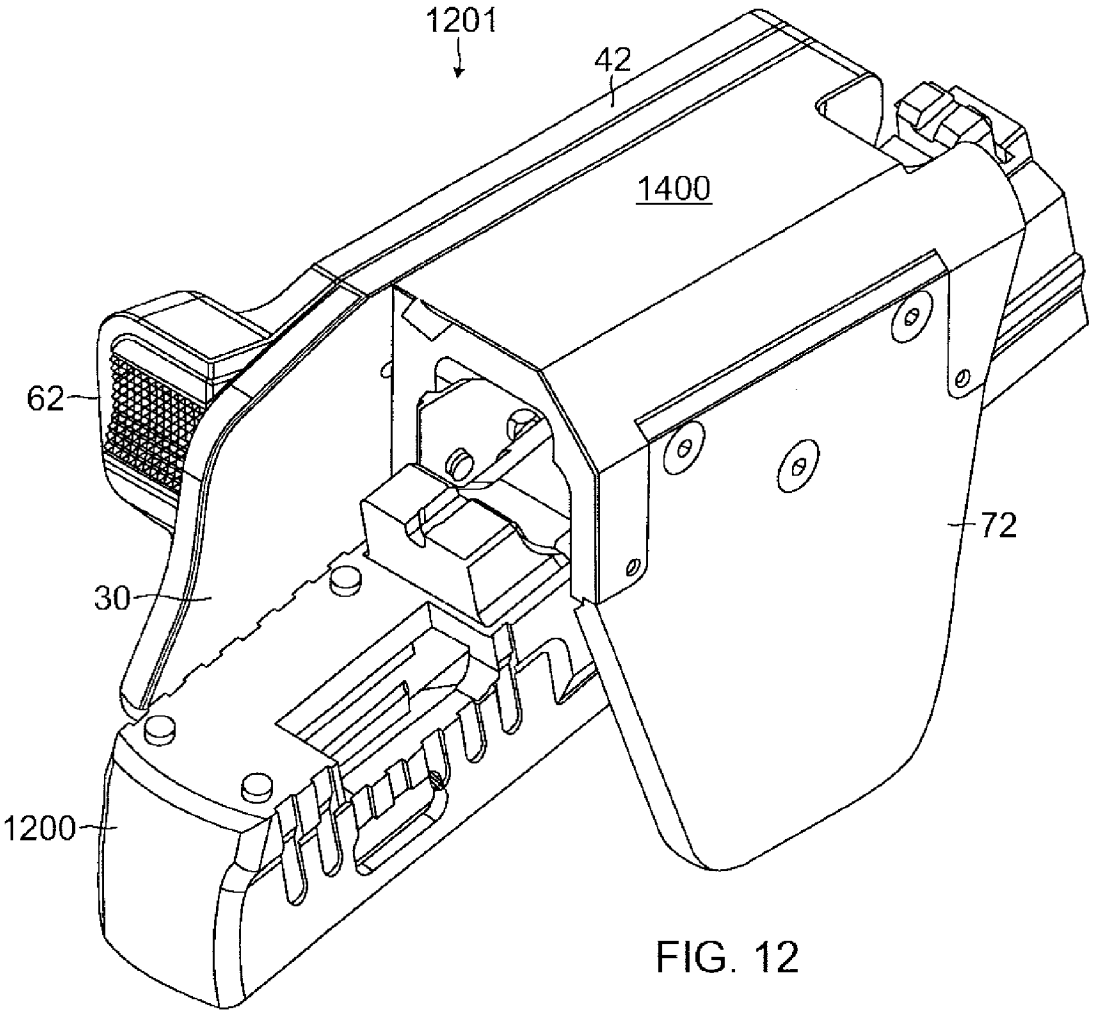
FIG. 12 is a perspective view of a holster and gun slide in accordance with a second embodiment.
Figure 13:
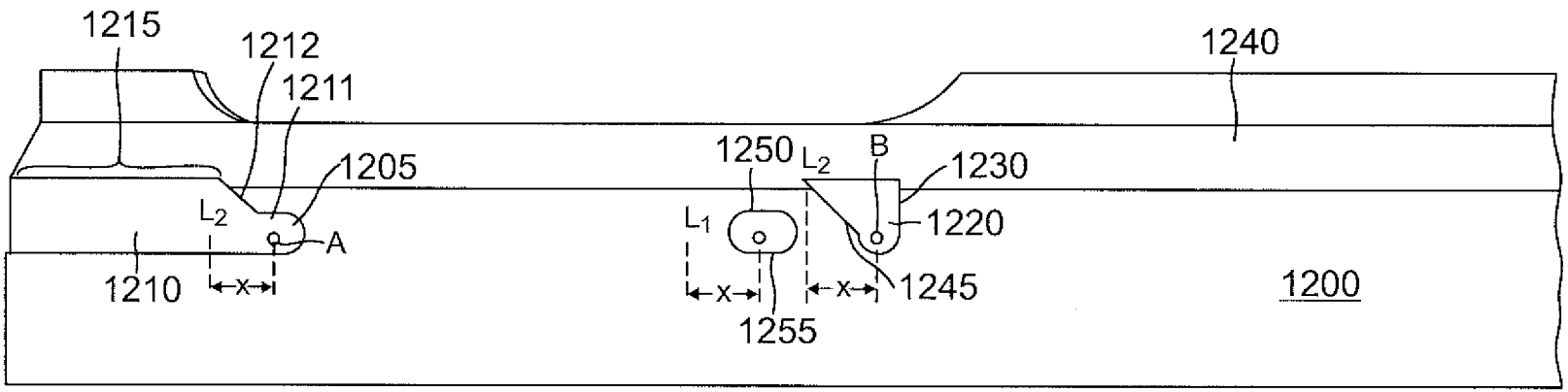
FIG. 13 is a plan view of the gun slide of FIG. 12.
Figure 14:
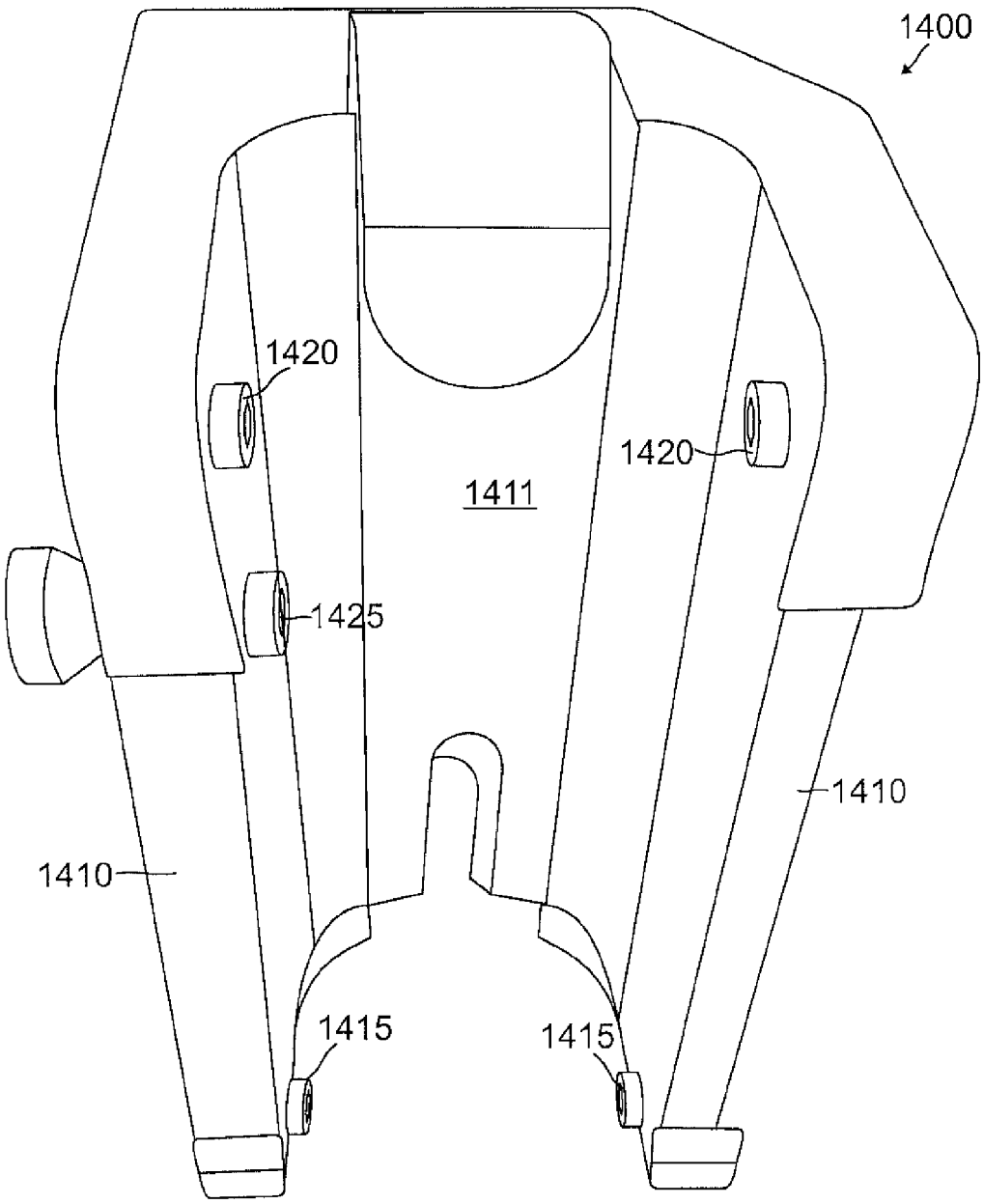
FIG. 14 is a perspective view of the adapter in the holster of FIG. 12.

In the second embodiment, a handgun component is configured with receiving elements such as slots or recesses that receive corresponding projecting element on the holster. The following discussion addresses an embodiment in which the hand gun slide is configured with the receiving elements. But it will be appreciated that other handgun components such as a laser sight may instead be configured with the receiving elements. A suitable handgun component is sufficiently elongated to include the necessary receiving features. Turning now to FIG. 12, a handgun slide 1200 is received by an adapter 1400 within a holster 1201. A plan view of slide 1200 is shown in FIG. 13. Similarly, a perspective view of adapter 1400 is shown in FIG. 14. Adapter 1400 includes a pair of opposing sidewalls 1410 joined by a top plate 1411. There is no bottom plate such that the combination of sidewalls 1410 and top plate 1411 form a longitudinally-extending cavity having a U-shaped cross section that is open on the bottom side for receiving slide 1200.

Figure 15:
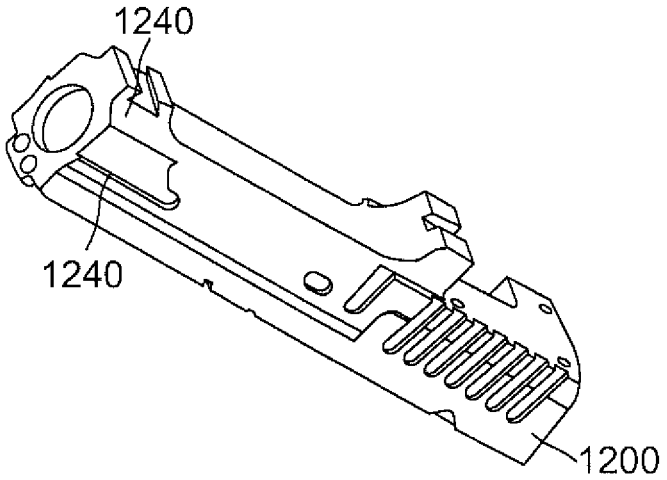
FIG. 15 is a perspective view of the gun slide of FIG. 13.

Adapter 1400 includes a plurality of projecting features that engage with corresponding receiving features in slide 1200. For example, adapter 1400 may include a plurality of guide pins that project inwardly from the inner surface of sidewalls 1410. In one embodiment, these guide pins comprise a pair of distal pins 1415 and a pair of proximal pins 1420. Slide 1200 includes a corresponding plurality of slots on each slide sidewall adapted to engage with guide pins 1415 and 1420. To receive distal pins 1415, the distal portion of each slide sidewall has a distal slot 1205. A bottom guide wall 1210 for distal slot 1205 longitudinally extends to the distal end for slide 1200. FIG. 15 is a perspective view of slide 1200 to better illustrate bottom guide wall 1210. An upper guide wall for slot 1205 includes a relatively-short section 1211 that is parallel with guide wall 1210. A majority of the upper guide wall for slot 1205 forms an angled portion 1212 with respect to bottom guide wall 1210 and thus does not extend to the distal end of slide 1200. A distal portion 1215 of slot 1205 is thus open at the top and only closed at the bottom by bottom guide wall 1210. In this fashion, a user may readily engage slide 1200 within adapter 1400 as follows.

FIG. 16*a* shows a user inserting gun slide 1200 distally within the open cavity of holster 1201. For illustration clarity, the remaining portions of the handgun are not shown except for slide 1200. Because holster 1201 is closed at the top such that a user must insert the gun from below with respect to this closed top, the user will typically orient the gun barrel slightly at a an angle with respect to the longitudinal axis of holster 1201. Referring again to FIGS. 13-15, each lower guide wall 1210 will thus engage with its corresponding distal pin 1415. As the user inserts the gun more and more distally within the holster, each pin 1415 will thus hit a back wall of its corresponding slot 1205 such that a central axis of pin 1415 will be located at position "A" of FIG. 13. The back wall for each slot 1205 thus prevents any further insertion of slide 1200 distally within holster 1201. Each of these back walls thus acts as a stop with respect to any further insertion of the gun into the holster. FIG. 16*b* illustrates the orientation of slide 1200 in holster 1201 at this point.

Since pins 1415 are engaged with slots 1205 at position A, the proximal portion of gun slide 1200 can be rotated towards holster 1201 as indicated by arrow 1600 in FIG. 16*b* to be fully engaged within holster 1201 as shown in FIG. 16*c*. Referring again to FIGS. 13-15, adapter 1400 includes a pair of proximal pins 1420 inwardly projecting from respective inner surfaces of sidewalls 1410. Slide 1200 includes a pair of proximal slots 1220 configured to receive proximal pins 1420. Each proximal slot 1220 includes a generally vertically-oriented back guide wall 1230. With respect to each proximal slot 1220, back guide wall 1230 guides its corresponding pin 1420 as the user rotates the proximal portion of slide 1200 into holster 1201 as discussed with respect to FIG. 16*b*. The axis of rotation is thus with regard to the stops formed by the back wall of slots 1205. In the fully-engaged position of FIG. 16*c*, a central axis of pin 1420 is then located at position "B" in slot 1220.

To lock slide 1200 into holster 1201 in this fully-engaged position, adapter 1200 may include one or more locking pins. In the embodiment shown in FIGS. 12-16*c*, adapter 1200 includes just one locking pin 1425. Locking pin 1425 is resiliently biased to project inwardly from an inner surface of adapter sidewall 1410. Slide 1200 includes a chamfer 1240 between its upper surface and its sidewalls. Chamfer 1240 thus engages pin 1425 as the slide is locked into its fully-engaged position within holster 1201 such that locking pin 1425 is pressing against the slide sidewall at point 1250. As the user continues to rotate slide 1200 into the fully-engaged position, locking pin 1425 is aligned with a latching recess 1255 on slide 1200. At this point, the resilient bias on locking pin 1425 forces pin 1425 into latching recess 1255 such that slide 1200 (and thus the corresponding hand gun) is fully-engaged within holster 1201 and locked into position.

It will be appreciated that alternative embodiments may be constructed in which the locking pin is also a guide pin. For example, recess 1255 could be eliminated such that one of slots 1220 would also include a recessed portion. Such a slot would then serve both a guiding function during engaging and disengaging the weapon from the holster as well as a latching function. Thus, although the following discussion is directed to an embodiment with separate locking and guide pins, it will be appreciated that the disclosure encompasses alternative embodiments with a dual locking and guide feature.

Figure 17:
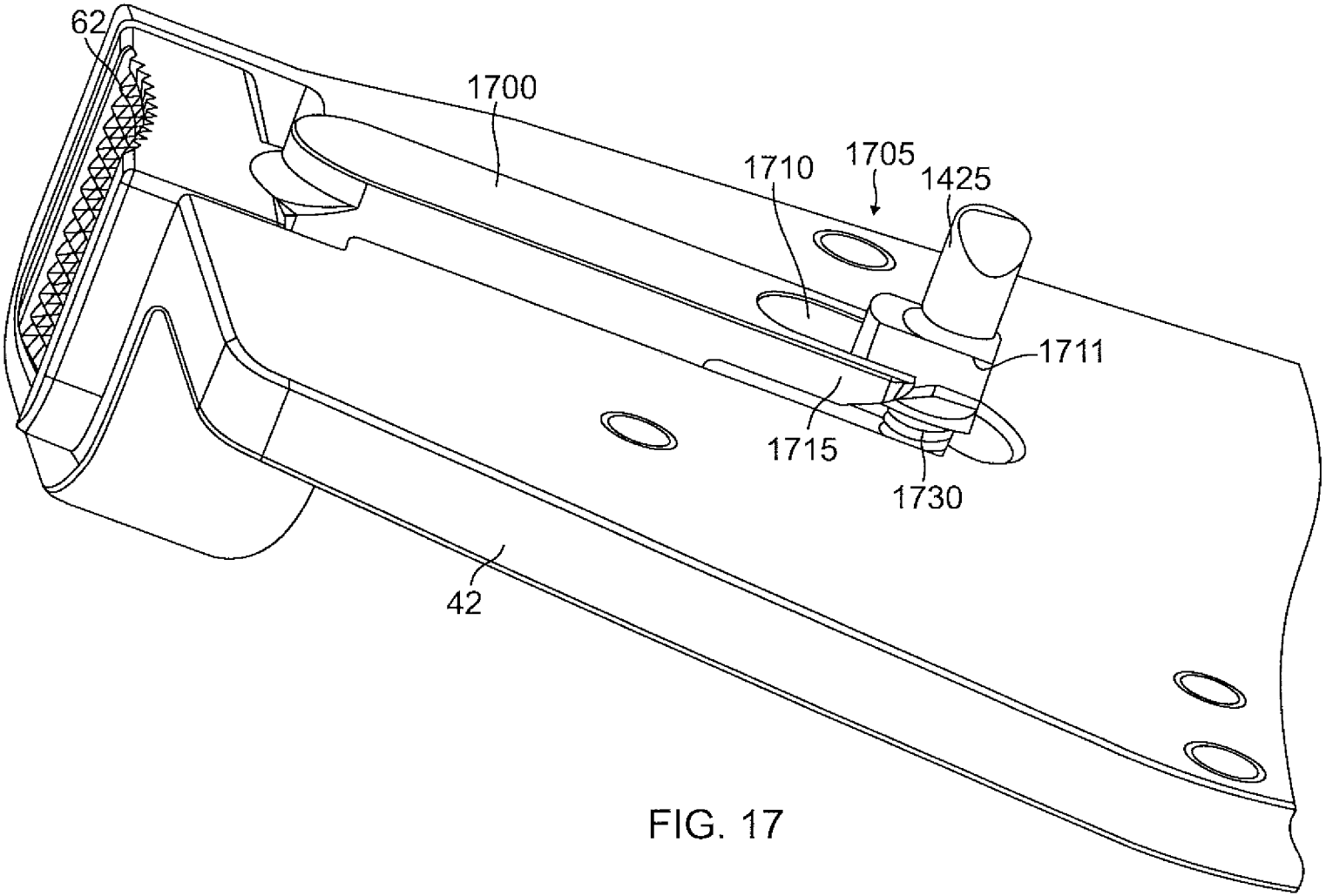
FIG. 17 is a perspective view of the linear cam mechanism within the holster of FIG. 12.

To disengage slide 1200 from its full-engaged position within holster 1201, a user needs some mechanism for withdrawing locking pin 1425 from latching recess 1255. This disengagement is analogous to that described earlier with regard to the first embodiment (FIGS. 1-11*b*). Because of this similarity, the following discussion is merely a summary in that analogous components have already been described with regard to the first embodiment. Thus, as seen in FIG. 12, holster 1200 may include a pushbutton 62. Adapter 1400 connects to a distal side cover plate 72 that may also function as a trigger guard. In addition, adapter 1400 connects to a proximal side cover plate 30. An additional proximal side cover plate 42 connects to plate 30 and houses push button 62. A perspective view of the distal side of additional proximal side cover plate 42 is shown in FIG. 17. Push button 62 connects to a shaft 1700 of a linear cam 1705. Linear cam 1705 includes a recess or slot 1710 for receiving a flat-sided main body 1711 of locking pin 1425. Linear cam 1705 thus forms a pair of wedge-shaped arms 1715 about recess 1710. These wedge-shaped arms 1715 cam against corresponding cam surfaces on main body 1711 of locking pin 1425. As a user presses push button 62 to withdraw locking pin 1425 from latching recess 1255 (FIG. 13), wedge-shaped arms 1715 thus actuate locking pin 1425 to compress a spring 1730. Spring 1730 would otherwise resiliently bias locking pin 1725 towards latching recess 1255. Push button 62 itself is resiliently biased (for example, by another spring, not illustrated) so that when a user releases push button 62, linear cam 1705 withdraws away from locking pin 1425 so that spring 1730 can again resiliently bias locking pin 1425 into latching recess 1255 on slide 1200. It will be appreciated that other cam mechanisms may be used to linearly displace locking pin 1425 in this fashion. As also shown in FIG. 17, the distal end of locking pin 1425 may be wedge-shaped in a complementary fashion to chamfer 1240 on slide 1200.

Referring again to FIG. 13, proximal slots 1220 include an angled distal guide wall 1245. With locking pin 1425 withdrawn from latching recess 1255, each proximal pin 1420 (FIG. 14) will be guided by corresponding angled distal guide wall 1245 as a user withdraws the gun from the holster. The user need merely withdraw the gun the distance "x" shown in FIG. 12 from latched position B until angled distal guide wall 1245 is completely free of pin 1420. A similar release occurs with regard to angled upper guide wall 1212 of each slot 1205 to release from corresponding distal pins 1415 (FIG. 14). Distance "x" shown in FIG. 13 may be relatively short, such as ½ inch, or even ⅜ inch or less. In this fashion, a user need merely withdraw the gun this short distance from the holster after pressing push button 62 to release the gun from the holster. Such a "quick draw" is quite advantageous in combat or police situations. Despite such a quick release, the gun is secured with relative ease as described with regard to FIGS. 16*a-c*. A handgun component such as a slide (or an alternative gun component such as a laser sight) is readily machined with the necessary slots and recesses, which lowers construction costs. Accordingly, the embodiments disclosed herein are quite advantageous. As discussed with regard to the first embodiment, holster 1201 may be constructed from discrete parts or may be formed using a molding process.

The foregoing description is presented so as to enable any person skilled in the art to make and use the invention. For purposes of explication, specific nomenclature has been set forth to provide a thorough understanding of the disclosure. However, it should be understood that the descriptions of specific embodiments or applications provided herein are provided only by way of some example embodiments of the invention, and not by way of any limitations thereof. Indeed, various modifications to the embodiments will be readily apparent to those skilled in the art, and the general principles defined herein can be applied to other embodiments and applications without departing from the spirit and scope of the invention. Thus, the present invention should not be limited to the particular embodiments illustrated and described herein, but rather, should be accorded the widest possible scope consistent with the principles and features disclosed herein.

What is claimed is:

1. A gun holster, comprising:

an adapter having an internal cavity defined by a pair of generally parallel side walls held in spaced opposition to each other by a top wall, the internal cavity being configured to receive a handgun component;

a plurality of fixed projecting features comprising a plurality of pins on an inner surface of the side walls and projecting into the internal cavity, each fixed projecting feature adapted to be received by corresponding receiving features on the handgun component;

a movable projecting feature on an inner surface of one of the side walls, the movable projecting feature being resiliently biased to project into the internal cavity, the movable projecting feature adapted to be engaged by a latching feature on the handgun component; and a mechanism for actuating the movable projecting feature against its resilient bias so as to withdraw the movable projecting feature from engagement with the latching feature.

2. The holster of claim 1, wherein the movable projecting feature comprises a locking pin resiliently biased to project into the internal cavity.

3. The holster of claim 2, wherein the mechanism comprises a linear cam configured to cam the locking pin away from the internal cavity.

4. The holster of claim 3, wherein the mechanism further comprises a push button interconnected with the linear cam through a shaft.

5. The holster of claim 1, wherein the plurality of pins comprises a distal pair of pins located adjacent a distal end for the holster.

6. The holster of claim 5, wherein the plurality of pins further comprises a proximal pair of pins located adjacent a proximal end for the holster.

7. A handgun component adapted to be received by a holster, comprising:

an elongated body having a distal end and opposing sides;

a first pair of slots adjacent the distal end on the opposing sides, each slot in the first pair being configured to receive a corresponding pin from the holster; and a second pair of slots proximally located with regard to the first pair of slots on the opposing sides, each slot in the second pair being configured to receive a corresponding pin from the holster; and a latching recess on one of the opposing sides, the latching recess being configured to receive a locking pin from the gun holster.

8. The handgun component of claim 7, wherein the handgun component comprises a slide.

9. The handgun component of claim 7, wherein the handgun component comprises a sight.

10. The handgun component of claim 8, wherein each slot in the first pair has a lower guide wall that is parallel with a longitudinal axis for the slide.

11. The handgun component of claim 10, wherein each slot in the second pair has a back guide wall that is substantially orthogonal to the longitudinal axis for the slide.

12. The handgun component of claim 11, wherein each slot in the second pair has an upper guide wall that is angled with respect to the longitudinal axis for the slide.

13. The handgun component of claim 12, wherein each slot in the first pair has an upper guide wall that is angled with respect to the longitudinal axis for the slide.

14. A method of engaging a handgun component into a holster, comprising:

while first projecting features comprising guide pins in the holster engage first guide walls on the handgun component, inserting the handgun component into the holster until the first projecting features engage stops on the handgun component; and while the first projecting features engage the stops, rotating the handgun component about the stops so that second projecting features in the holster engage second guide walls on the handgun component.

15. The method of claim 14, further comprising:

while rotating the handgun component, engaging a locking feature on the holster with a latching recess in the handgun component to fully engage the handgun component in the holster.

16. The method of claim 15, wherein the locking feature is a locking pin.

17. The method of claim 15, wherein the locking feature is also one of the second projecting features.

18. The method of claim 15, further comprising disengaging the handgun component from the holster responsive to actuation of a push button mechanism.

* * * * *